US009974406B1

(12) United States Patent
Von Drake

(10) Patent No.: US 9,974,406 B1
(45) Date of Patent: May 22, 2018

(54) QUICK DRAPE HANGER

(71) Applicant: Valarie Von Drake, Fishers, IN (US)

(72) Inventor: Valarie Von Drake, Fishers, IN (US)

( * ) Notice: Subject to any disclaimer, the term of this patent is extended or adjusted under 35 U.S.C. 154(b) by 0 days. days.

(21) Appl. No.: 14/719,457

(22) Filed: May 22, 2015

(51) Int. Cl.

| | |
|---|---|
| ***A47H 1/142*** | (2006.01) |
| ***A47H 1/102*** | (2006.01) |
| ***A47H 1/122*** | (2006.01) |
| ***A47H 1/13*** | (2006.01) |
| ***A47H 1/124*** | (2006.01) |
| ***A47H 1/14*** | (2006.01) |

(52) U.S. Cl.
CPC ..... *A47H 1/142* (2013.01); *A47H 1/102* (2013.01); *A47H 1/122* (2013.01); *A47H 1/124* (2013.01); *A47H 1/13* (2013.01); *A47H 1/14* (2013.01)

(58) Field of Classification Search
CPC ..... A47H 1/142; A47H 1/14; A47H 1/102; A47H 1/13; A47H 1/122; A47H 1/124; A47G 25/2692
USPC ..... 248/262, 261, 251, 252, 254, 267, 273
See application file for complete search history.

(56) References Cited

U.S. PATENT DOCUMENTS 68,189 A * 8/1867 Hanks ..... E06B 9/50 248/267
255,471 A * 3/1882 Stone ..... A47H 1/142 248/262
294,385 A * 3/1884 Hemmenway ..... E06B 9/50 248/216.1
679,677 A * 7/1901 Housberg ..... A47H 1/122 248/265
696,404 A * 4/1902 Bongart ..... A47H 1/13 248/259
744,691 A * 11/1903 Porter ..... A47H 1/142 248/262
859,339 A * 7/1907 Saxon ..... E06B 9/50 248/267
896,347 A * 8/1908 Avery et al. ..... A47H 1/13 248/260
919,988 A * 4/1909 Witzal et al. ..... A47H 1/13 248/224.7
930,380 A * 8/1909 Hudson ..... A47H 1/13 248/254
951,440 A * 3/1910 Hoxworth ..... A47H 1/13 248/254
1,250,846 A * 12/1917 Gessner ..... A47H 1/13 248/257
1,258,693 A * 3/1918 Magrini ..... A47H 1/13 248/258
1,330,358 A * 2/1920 Teft ..... A47H 1/122 248/255

(Continued)

*Primary Examiner* — Nkeisha Smith
(74) *Attorney, Agent, or Firm* — Woodard, Emhardt, Moriarty, McNett & Henry LLP

(57) ABSTRACT

An assembly for the support of curtains or drapes about the interior of a frame of a window and a venetian type blind affixed to the window frame. The bracket provides for installation of opposing brackets with little, if any, measurement required. The assembly consists of two brackets that with or without shims, are set horizontally in between the frame of a window and a venetian type blind affixed to the window frame. A conventional curtain road or drapery rod is then simply placed horizontally an top of the brackets in the installed position. Eliminating the necessity of attaching any support to the walls thus eliminating all nails, or other fasteners in the framework or in the drywall that would normally support a curtain rod.

3 Claims, 9 Drawing Sheets

(56) References Cited

U.S. PATENT DOCUMENTS 1,354,974 A * 10/1920 Hunter ..... A47H 1/13 248/254
1,451,764 A * 4/1923 Dick ..... E06B 9/50 248/254
1,480,841 A * 1/1924 Simmons ..... A47H 1/16 248/254
2,233,430 A * 3/1941 Ratcliffe ..... A47H 1/13 248/254
2,386,854 A * 10/1945 Hilton ..... A47H 1/142 248/254
2,538,755 A * 1/1951 Bradley ..... A47H 1/18 16/102
2,925,861 A * 2/1960 Long ..... E06B 9/325 160/178.1 R
3,312,442 A * 4/1967 Moeller ..... A47G 1/20 248/216.1
3,907,240 A * 9/1975 Belli ..... A47H 1/14 248/254
4,228,980 A * 10/1980 Beauchamp ..... A47H 1/18 16/87.2
4,613,108 A * 9/1986 Sundstrom ..... A47G 1/20 248/216.1
4,684,095 A * 8/1987 Athey ..... A47H 1/142 160/903
4,756,499 A * 7/1988 Burke ..... A47G 1/1653 248/216.4
5,028,030 A * 7/1991 Lewis ..... A47G 1/20 248/218.2
5,979,848 A * 11/1999 Kuthy ..... A47H 1/10 160/902
8,231,093 B2 * 7/2012 Tran ..... A47H 1/142 16/87.2
8,356,782 B2 * 1/2013 Robichaud ..... A47G 25/0635 248/217.1
8,418,975 B1 * 4/2013 Burr ..... A47H 1/142 248/261
2008/0156952 A1 * 7/2008 Nathan ..... A47H 1/102 248/262

* cited by examiner

QUICK DRAPE HANGER

BACKGROUND OF THE INVENTION

This invention relates to brackets used to support curtain rods, draperies and other window treatments. More particularly, the invention relates to a universal, low cost, bracket for the purpose recited, which can be easily installed with only minimum measurement.

With a conventional drapery or curtain installation it is generally necessary to employ one or more of any number of various supporting fixtures or brackets presently available. It is known that curtain rods and draperies typically require one type of supporting fixture. There are any number of rods and hangers for supporting window treatments, such as crane rods, festoon holders and various types of draw curtains, cornice mountings and valence boards. Corresponding brackets, fixture and supports are generally attached to a wooden frame member of a window, alcove, entry-way, door way or the like. It is often difficult to install these support brackets in a proper position and in a proper spatial relationship with an opposing support bracket (since pairs of properly spaced and properly aligned support brackets are typically required to properly install the desired window treatment). Subsequent removal of a support bracket leaves exposed screw, nail or tack holes in the face of the woodwork or wooden frame member. The support fixtures or brackets that are mountable at the edges of the woodwork generally deface or cover the face of the woodwork. There are presently known a number of schemes for overcoming some of the identified disadvantages.

There are no notable devices, support fixtures or brackets that are mountable in between the woodwork of wooden frame member dry walled and an affixed venetian type blind.

Accordingly, it is an object of the present invention to provide a bracket that can be easily installed without nails, tacks, screws or other fasteners. The bracket simply inserts in between a window frame and the top of an affixed venetian type blind. The bracket positions the curtain rod, bar or the like, with respect to the window, door, alcove, bay framing or the like.

Another object of the present invention is to provide a bracket that can be inexpensively manufactured from a desired material. The finished brackets are produced efficiently and with a minimum of waste.

Still another object of the present invention is to provide a bracket that can be mounted or removed with few if any tools and little if any measurement.

In the present invention the bracket is inserted in between the framework of a window and a parallel venetian type blind and is at least partially supported by the wall portion in reaction to the weight of the rod, drape, panel, or the like supported by the bracket. In another embodiment the bracket can be inserted with a shim for leveling or glue strips for securing the rod to the bracket or screws, should the rod want or need to be permanently installed.

Figure 1:
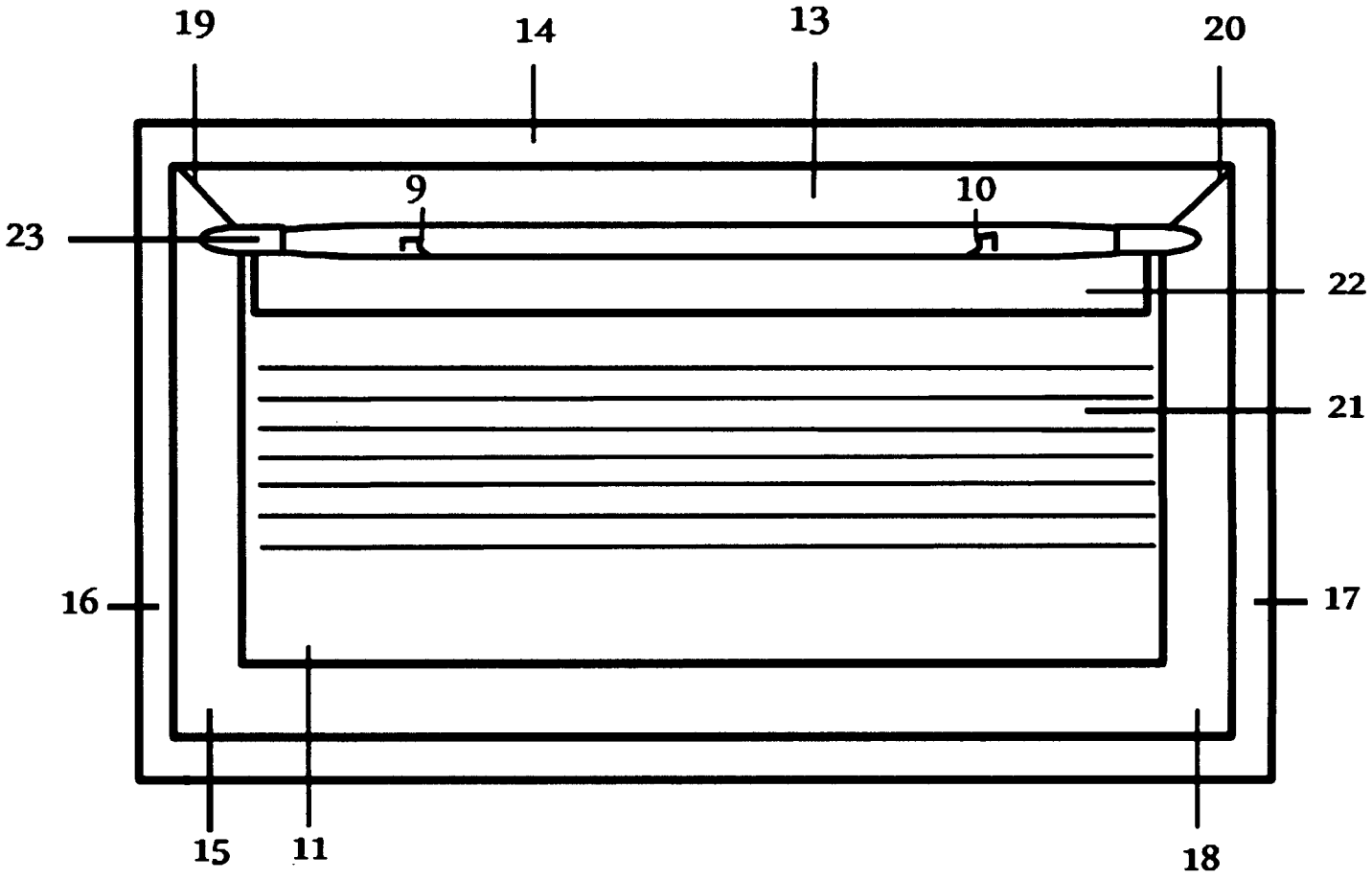
FIG. 1 is a perspective view of a pair of brackets in accordance with this invention shown supported by the framing of a window and an affixed venetian type blind.

Referring now to the drawings there is shown a preferred embodiment for the bracket. It will be understood that there are several options to secure and level the bracket to suit the supported fixture. The preferred embodiment and its options are described in connection with a curtain rod. The bracket of the present invention is particularly adapted for providing easy installation and removal in a window frame with little if any need for tools or measurements for installation or the alignment of a pair of the brackets.

The drawings show one single piece bracket 9 on the left and another single piece bracket 10 on the right of a case framed window 11. The cased frame window shown in FIG. 1 for the purpose of illustration includes upper and lower sash (now shown), and an upper frame member or trim portion 12. The trim portion 12 includes a face surface 13 and a top surface 14. It will be understood that use of the bracket is not limited to casement windows.

Referring now to FIG. 1, the cased frame window 11 has a side frame member 15 with a side surface 16. The upper frame member or trim member portion 13 and a side frame member 15 are typically joined at a mitered joint 19. As further shown in FIG. 1 the cased frame window 11 has an opposing side frame member 18 with an opposing side surface 17. The upper frame member or trim member portion 13 and the opposing side frame member 18 are typically joined at an opposing mitered joint 20. It will be understood that the component frame members of a cased frame window can be formed with any number or types of joints and construction is not limited to mitered joints. It will be further understood that the cased frame window 11 has been selected for purposes of illustration only and that the bracket of the present invention is suitable for use on other trimmed and untrimmed openings. The curtain rod brackets 9 and 10 are mounted at the upper corners of a window 11 in the usual manner for providing support of a drape or curtain in overlying relation to the window.

Figure 2:
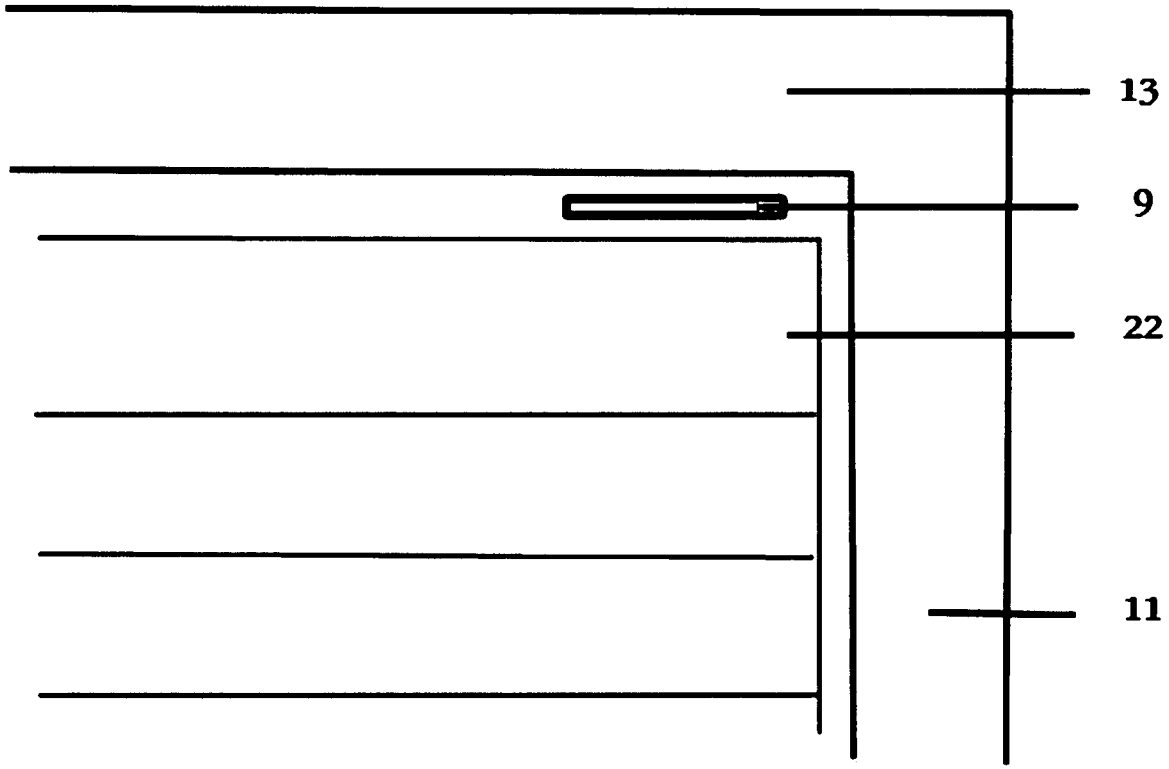
FIG. 2 is a plan rear view in accordance with this invention.

Referring now to FIG. 2, the cased frame 11 rear view of the bracket 9, with the upper frame member of trim and the installation bracket of the venetian type blind 21 as surrounding supportive fixtures in the cased frame window.

Figure 3:
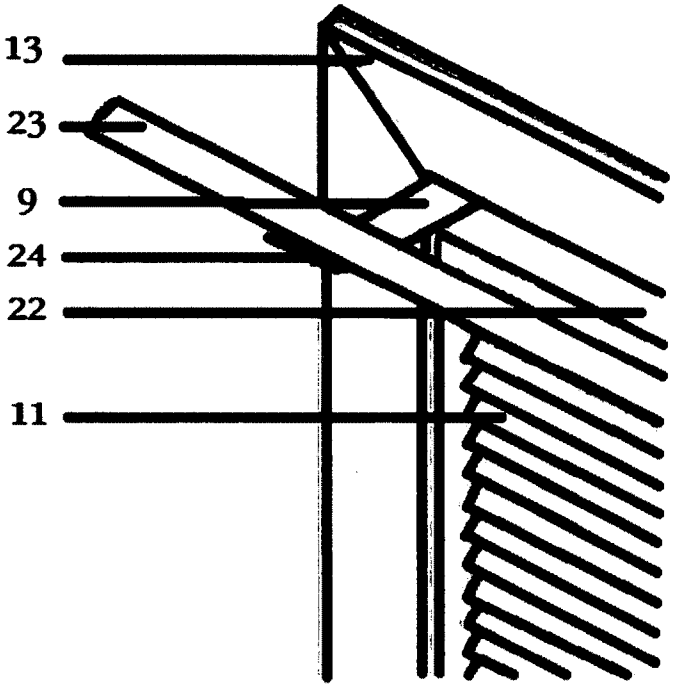
FIG. 3 is a plan view of a bracket in accordance with this invention shown from the top.

Referring now to FIG. 3, wherein a preferred embodiment of the assembly is shown, reference numeral 23 indicates the curtain rod and numeral 9 indicates the supportive bracket with the bend 24. Numeral 11 indicates the cased window frame, numeral 22 the venetian type blind valance and numeral 13 which acts as stabilization for the bracket.

Figure 4:
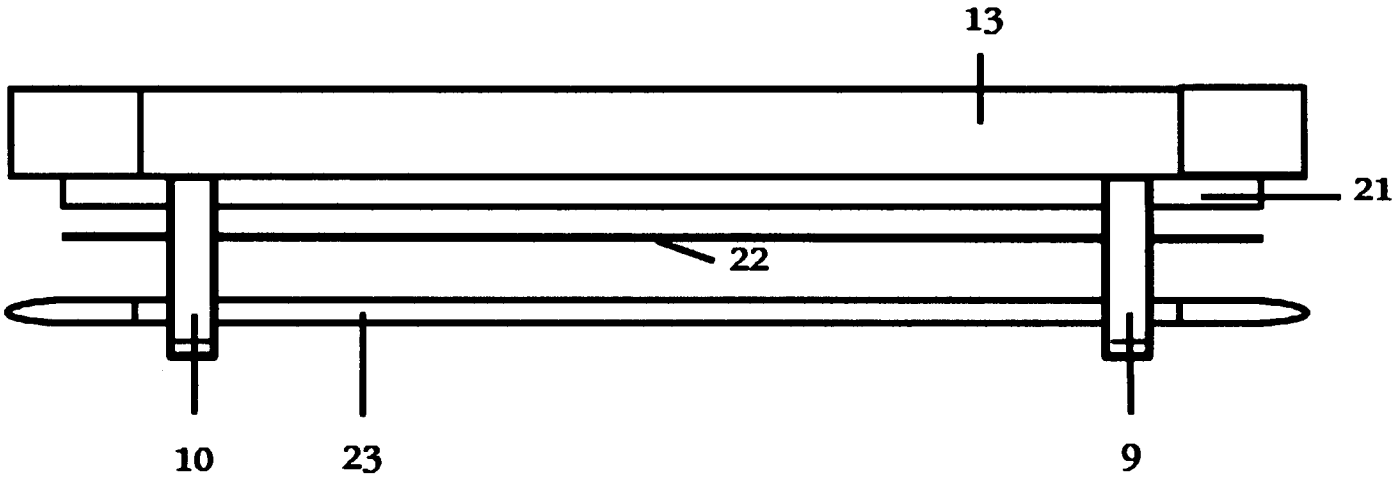
FIG. 4 is a plan view of a pair of brackets in accordance with this invention shown from the bottom.

Referring now to FIG. 4, the plan view of a pair of brackets in accordance with this invention shown from the bottom. Numeral 9 and 10 indicate the brackets, numeral 23 indicates the curtain rod, numeral 21 indicates the venetian type blind installation bracket, numeral 22 indicates the venetian type blind valance and numeral 13 indicates generally a portion of a window casing. Brackets 9 and 10 support rod 23 wholly outside of window casing 13.

Figure 5:
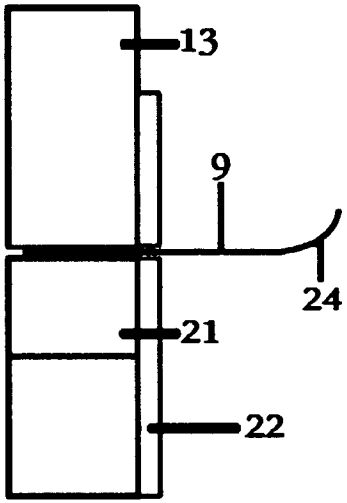
FIG. 5 is a plan side view of a bracket in a level, plum or square frame.

Referring now to FIG. 5, is an elevational view of a fabricated bracket for a single rod in a level, plum or square frame. Numeral 9 indicates the bracket, numeral 24 indicates the bend, numeral 13 indicates the upper frame member or trim member portion, numeral 22 indicates the venetian type blind valance and numeral 21 indicates the venetian type blind installation bracket.

Figure 6:
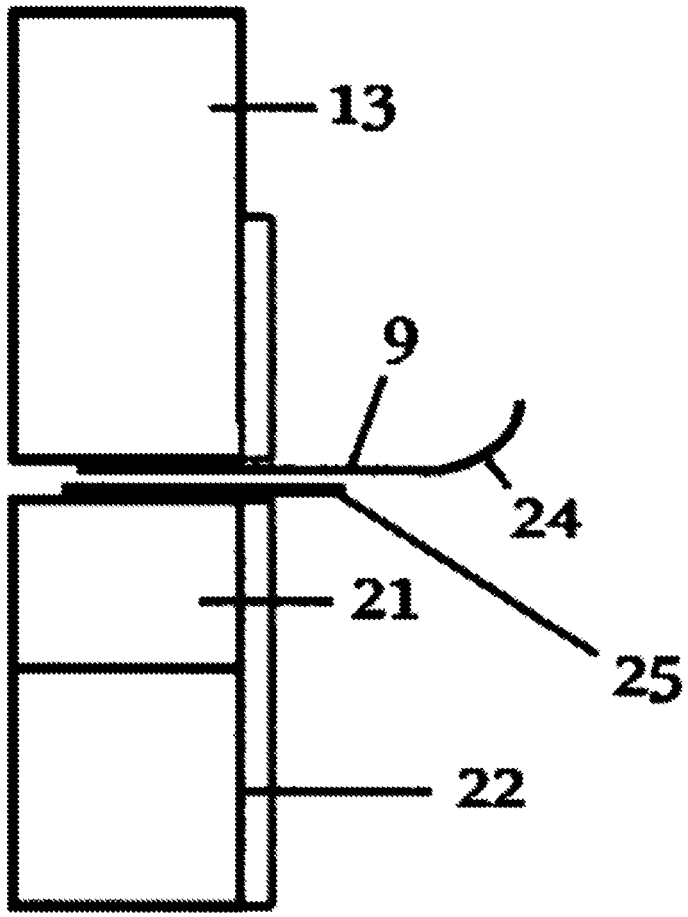
FIG. 6 is a plan side view of a bracket in an unlevel frame, balanced by a provided shim.

Referring now to FIG. 6, is an elevational view of a fabricated bracket for a single rod in an unlevel frame, balanced by a provided shim 25. Numeral 9 indicates the bracket, numeral 24 indicates the band, numeral 13 indicates the upper frame member or trim member portion, numeral 22 indicates the venetian type blind valance and numeral 21 indicates the venetian type blind installation bracket.

Figure 7:
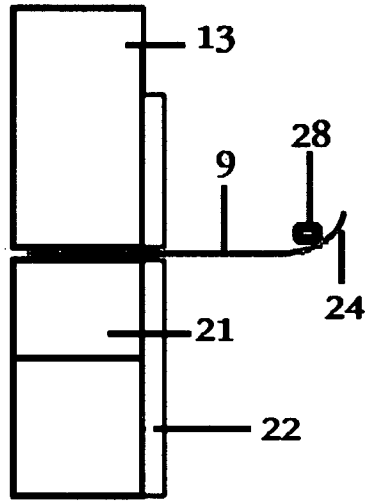
FIG. 7 is a plan side view of a bracket with an applied adhesive strip for more permanent attachment of the rod.

Referring now to FIG. 7, is an elevational view of a fabricated blank for a single rod in a level plum or square frame, with an adhesive strip 26 applied for further stability of a curtain rod. Numeral 9 indicates the bracket, numeral 24 indicates the bend, numeral 13 indicates the upper frame member or trim member portion, numeral 22 indicates the venetian type blind valance and numeral 21 indicates the venetian type blind installation bracket.

Figure 8:
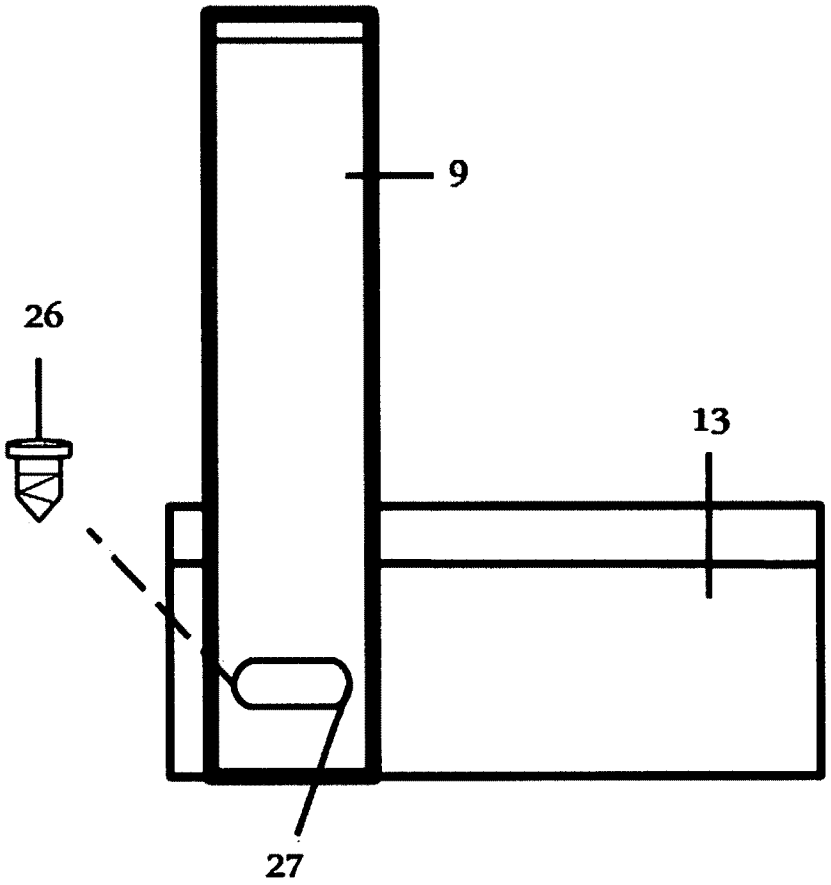
FIG. 8 is a plan of the bracket viewed from the bottom in a permanently supported position.

Referring now to FIG. 8, is a plan bracket viewed from the bottom in a permanently supported position. Numeral 9 indicates the bracket, numeral 13 indicates the upper frame member or trim member portion and numeral 25 indicates that bracket 9 is pierced 25 to receive screws 26 by means of which the bracket 9 is securely affixed to the wall surface.

Figure 9:
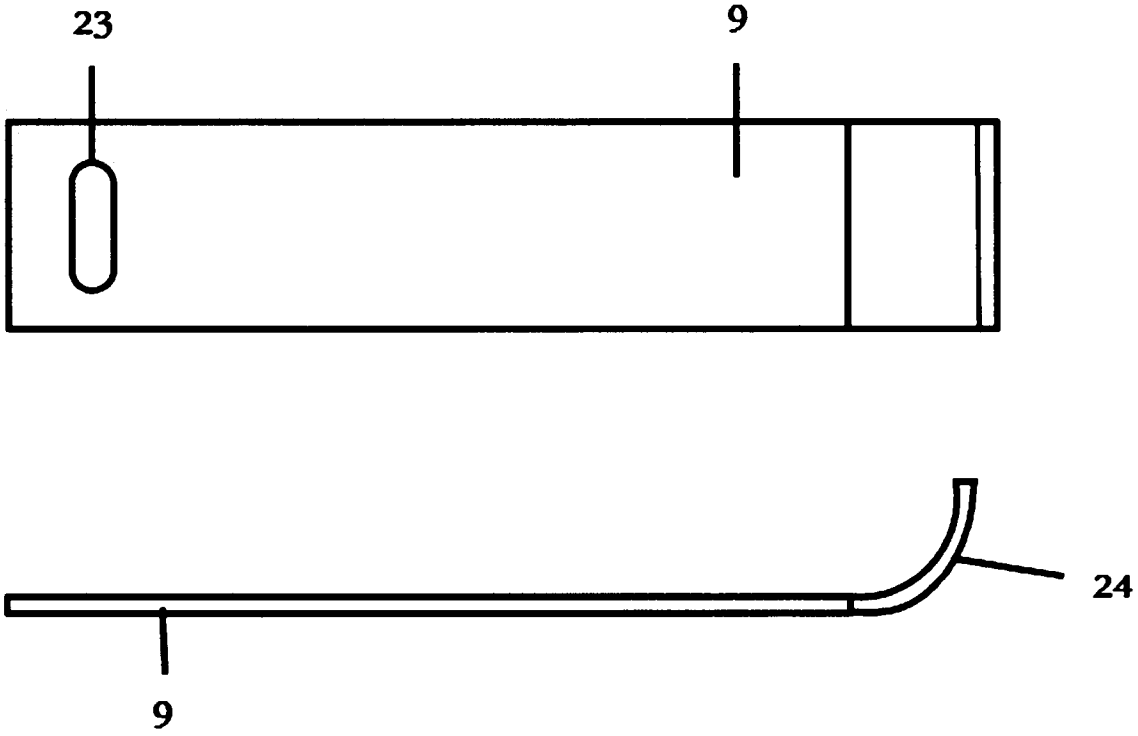
FIG. 9 is a partial plan view of the material illustrating the bracket in accordance with this invention, sizes may vary in length due to the depth of window variations.

Referring now to FIG. 9, is a plan view of the material illustrating the bracket in accordance with this invention. The numeral 9 indicates the bracket, the numeral 24 indicates the bend or tongue curved outwardly extending for the like for engagement with a curtain rod and the numeral 25 indicates the piercings in vertical alignment that are equally spaced in relation to each other for permanent attachment.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

References Cited in the file of this patent U.S. Pat. No. 2,770,437 Erwin Nov. 13, 1956, 3049327 Caudell Aug. 14, 1962

The invention claimed is:

1. A bracket system for mounting a curtain rod to a window with a window frame having an upper frame member, wherein a venetian blind is fastened to the upper frame member, the bracket system comprising:

- a plurality of brackets for mounting a curtain rod to a window, each bracket comprising:
  - a mounting portion adapted to be positioned and secured between the upper frame member of the frame and the venetian blind;
  - a rod-attachment portion; and
  - a connecting portion extending between and connecting the mounting portion and the rod-attachment portion, wherein the rod-attachment portion includes an upward curve configured to hold the curtain rod when the mounting portion is secured between the upper frame member and the venetian blind, wherein the connecting portion spaces the connecting portion apart from the window frame when the mounting portion is positioned and secured between the upper frame member and the venetian blind so that the rod positioned on the connecting portion is wholly outside of the window frame; and
- a plurality of shims adapted to be wedged between the brackets and the venetian blind to secure the brackets in position by friction.

2. The bracket system of claim 1, wherein the mounting portion, the connecting portion and the rod-attachment portion are unitarily formed from a piece of sheet material.

3. The bracket system of claim 1, wherein the mounting portion, the connecting portion and the rod-attachment portion are unitarily formed from a flat piece of material, wherein the mounting portion and the connecting portion are collectively flat with the rod-attachment portion bent upwardly from the connecting portion.

* * * * *